US008439982B2

(12) United States Patent
Yager

(10) Patent No.: US 8,439,982 B2
(45) Date of Patent: May 14, 2013

(54) DYEING OF FIBERS USING SUPERCRITICAL CARBON DIOXIDE AND ELECTROPHORESIS

(75) Inventor: Thomas A. Yager, Encinitas, CA (US)

(73) Assignee: Empire Technology Development LLC, Wilmington, DE (US)

( * ) Notice: Subject to any disclaimer, the term of this patent is extended or adjusted under 35 U.S.C. 154(b) by 262 days.

(21) Appl. No.: 13/125,006

(22) PCT Filed: Aug. 27, 2010

(86) PCT No.: PCT/US2010/046943

§ 371 (c)(1), (2), (4) Date: Apr. 19, 2011

(87) PCT Pub. No.: WO2012/026944

PCT Pub. Date: Mar. 1, 2012

(65) Prior Publication Data

US 2012/0047665 A1 Mar. 1, 2012

(51) Int. Cl.
*D06P 1/00* (2006.01)

(52) U.S. Cl.
USPC ..... 8/474; 8/475; 8/495

(58) Field of Classification Search ..... 8/474, 475, 8/495
See application file for complete search history.

(56) References Cited

U.S. PATENT DOCUMENTS

| | | | |
|---|---|---|---|
| 4,115,234 | A | 9/1978 | Anselrode |
| 4,610,939 | A | 9/1986 | Mampaey et al. |
| 5,199,956 | A | 4/1993 | Schlenker et al. |
| 6,010,542 | A | 1/2000 | DeYoung et al. |
| 6,615,620 | B2 | 9/2003 | Hendrix et al. |
| 7,038,655 | B2 | 5/2006 | Herb et al. |
| 7,352,503 | B2 | 4/2008 | Yang et al. |
| 2001/0020311 | A1 | 9/2001 | Veugelers et al. |
| 2005/0054201 | A1 | 3/2005 | Ramachandrarao et al. |
| 2008/0028541 | A1 * | 2/2008 | Fernandez Cid et al. ..... 8/474 |

FOREIGN PATENT DOCUMENTS

| | | |
|---|---|---|
| WO | WO-01/04410 | 1/2001 |
| WO | WO-02/36271 | 5/2002 |
| WO | WO-02/096550 | 12/2002 |

OTHER PUBLICATIONS

Cid, M.V.F. et al., "A significant approach to dye cotton in supercritical carbon dioxide with fluorotriazine reactive dyes," J. of Supercritical Fluids, 2007, vol. 40, pp. 477-484.

Cid, M.V.F. et al., "Novel Process to Enhance the Dyeability of Cotton in Supercritical Carbon Dioxide," Textile Research Journal, 2007, vol. 77, pp. 38-46.

Drews, M. J. et al., "The effect of Supercritical $CO_2$ Dyeing Conditions on the Morphology of Polyester Fibers," Textile Chem. Colorist, Jun. 1998, vol. 30, No. 6, pp. 13-20.

Eastoe, J. et al., "Micellization of Hydrocarbon Surfactants in Supercritical Carbon Dioxide," J. Am. Chem. Soc., 2001, vol. 123, No. 5, pp. 988-989.

(Continued)

*Primary Examiner* — Eisa Elhilo
(74) *Attorney, Agent, or Firm* — Foley & Lardner LLP

(57) ABSTRACT

The present technology provides an illustrative method for dyeing textiles that includes intermixing a dye with supercritical carbon dioxide (sc-$CO_2$) to form a dye solution and immersing a fabric in the dye solution. The method further includes applying an electric field to the dye solution to cause charged particles of the dye solution to separate and cause the dye to diffuse into the fabric.

20 Claims, 4 Drawing Sheets

OTHER PUBLICATIONS

International Search Report and Written Opinion for PCT/US2010/046943 mailed Nov. 23, 2010.

Jun, J.H. et al., "Application of Perfluoropolyether Reverse Micelles in Supercritical $CO_2$ to Dyeing Process," Dyes and Pigments, 2004, vol. 61, pp. 17-22.

Kiyan, T. et al., "Pulsed and DC Discharges in Supercritical Carbon Dioxide," Pulsed Power Conf., 2007, 16th IEEE International V2, pp. 1528-1531.

Ryoo, W. et al., "Electrostatic Stabilization of Colloids in Carbon Dioxide: Electrophoresis and Dielectrophoresis," Langmuir, 2005, vol. 21, pp. 5914-5923.

Sainis, S.K. et al., "Electrostatic Interactions of Colloidal Particles in Nonpolar Solvents: Role of Surface Chemistry and Charge Control Agents," Langmuir, 2008, vol. 24, No. 4, pp. 1160-1164.

EPA website, "Case Study: Liquid Carbon Dioxide ($CO_2$) Surfactant System for Garment Care," Design for the Environment, May 1999, retrieved from the internet: <URL: http://www.epa.gov/dfe/pubs/garment/lcds/misb.pdf>, 5 pages.

Yonker, C.R. et al., "The Development of Improved Capillary Supercritical Fluid Chromatography and Mass Spectrometry," 1990, Battelle-Pacific Northwest Laboratories, Richland, WA, 3 pages.

* cited by examiner

DYEING OF FIBERS USING SUPERCRITICAL CARBON DIOXIDE AND ELECTROPHORESIS

CROSS-REFERENCE TO RELATED APPLICATIONS

The present application is a U.S. national stage application claiming the benefit of International Application No. PC/US2010/046943, filed on Aug. 27, 2010, the entire contents of which is incorporated herein by reference in its entirety.

BACKGROUND

The following description is provided to assist the understanding of the reader. None of the information provided or references cited is admitted to be prior art.

In traditional textile dyeing processes, large amounts of water are used as a dye solvent, resulting in one of the largest sources of water pollution for industrialized countries. An alternative dye solvent to water is super critical carbon dioxide (sc-$CO_2$). In addition to reducing water pollution, sc-$CO_2$ includes several advantages over water. The lower viscosity of sc-$CO_2$ allows for higher diffusion rates and lower mass transfer resistances than water, resulting in increased penetration of the dye into the fiber and decreased dyeing times. Thus, less energy is required for the dyeing process.

In addition, dye and sc-$CO_2$ can be easily separated and reused. In contrast, in the aqueous system, leftover water and dye cannot be easily separated and reused, resulting in large amounts of unusable, polluted water. The use of sc-$CO_2$ results in a dry dyed fabric, and thus does not require extensive drying time as does the aqueous system. Furthermore, the dyeing process using sc-$CO_2$ does not generate carbon dioxide and thus is not a direct contributor to green house gas emissions. In addition, sc-$CO_2$ can be recycled.

Synthetic fibers, such as polyester, can be easily dyed using a sc-$CO_2$ dyeing process. However, the application of the sc-$CO_2$ dyeing process to natural fibers, such as cotton and wool, has been limited thus far. Sc-$CO_2$ is a hydrophobic solvent, which does not swell hydrophilic cotton or wool fibers. Sc-$CO_2$ is unable to break the hydrogen bonds between adjacent molecular chains to disrupt the structure of the natural fibers in order to facilitate the diffusion of the dye into the fibers. In addition, most commercial cotton dyes are salts, which are insoluble in sc-$CO_2$ without the use of co-solvents. However, the use of co-solvents requires that the fabrics become saturated, thus requiring drying of the fabrics and more complex cleaning of the process chamber and dyeing components.

SUMMARY

The present technology provides an illustrative method for dyeing textiles that includes intermixing a dye with supercritical carbon dioxide (sc-$CO_2$) to form a dye solution and immersing a fabric in the dye solution. The method further includes applying an electric field to the dye solution to cause charged particles of the dye solution to separate and cause the dye to diffuse into the fabric.

The present technology further provides an illustrative apparatus for dyeing textiles that includes an intermixing component that intermixes a dye with super-critical carbon dioxide (sc-$CO_2$) to form a dye solution and a fabric immersion component that immerses a fabric in the dye solution. The illustrative apparatus further includes a cathode and an anode that produce an electric field in the dye solution that causes charged particles of the dye solution to separate and cause the dye to diffuse into the fabric.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Figure 1:
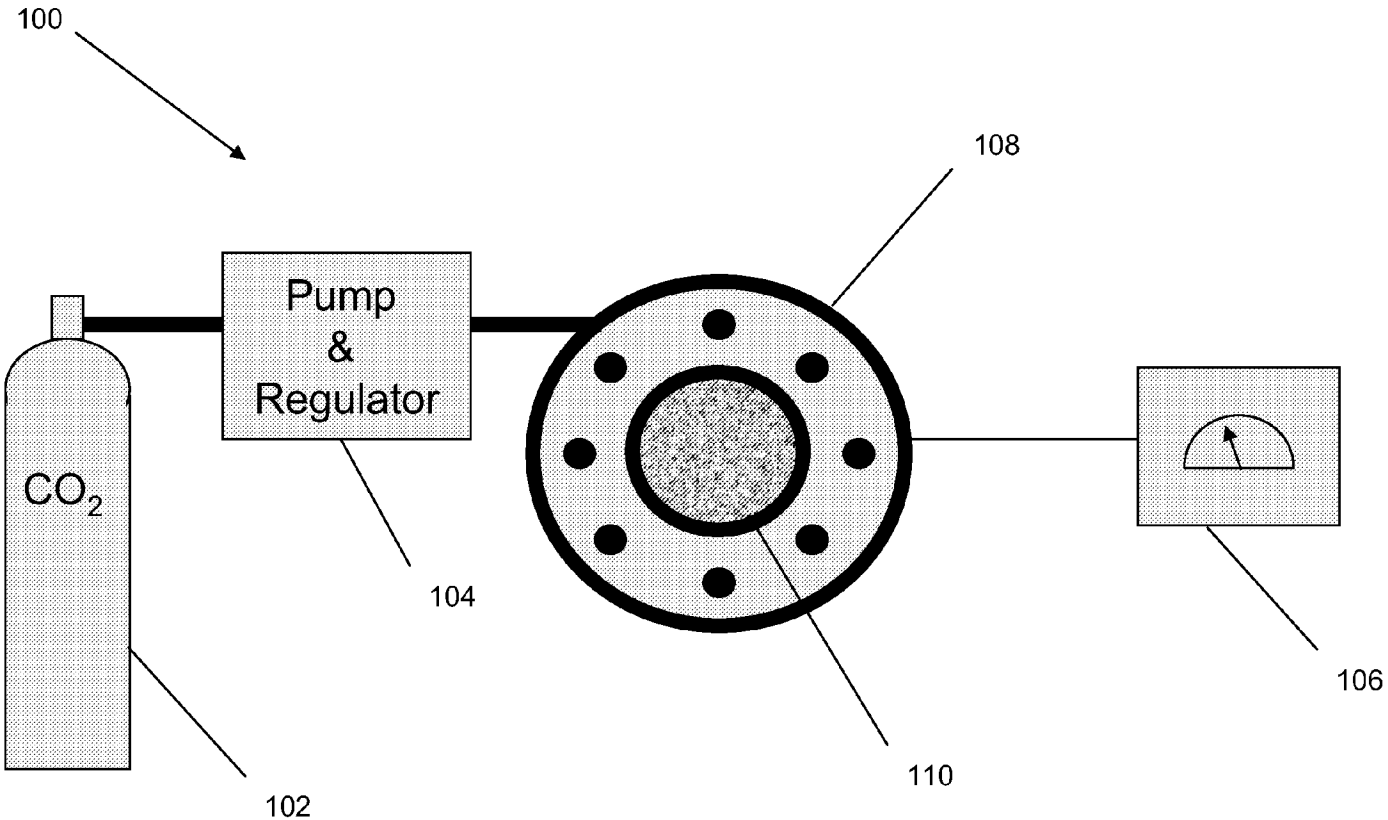
FIG. 1 depicts a sc-$CO_2$ dyeing system in accordance with an illustrative embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

There are several issues associated with traditional dyeing processes that utilize super critical carbon dioxide (sc-$CO_2$) as a dye solvent. These include, but are not limited to, the inability of the sc-$CO_2$ dyeing process to adequately adhere dyes to natural fibers such as, but not limited to, cotton, wool, silk, linen, hemp, and ramie. Sc-$CO_2$ is a hydrophobic solvent, which does not swell hydrophilic cotton fibers, and is unable to break the hydrogen bonds between adjacent molecular chains of the natural fibers. As a result, the structure of the natural fibers prevents the diffusion of the dye into the fibers. Described herein are illustrative systems, device, and methods for implementing an improved dyeing process that utilizes sc-$CO_2$ as a dye solvent. The improved dyeing process utilizes an electric field to enhance the diffusion of dye particles into the natural fibers. The dyeing processes and devices described below allow for the effective use of sc-$CO_2$ as a dye solvent for dyeing textiles made of natural fibers such as, but not limited to, cotton, wool, silk, linen, and ramie.

FIG. 1 depicts a sc-$CO_2$ dyeing system 100 in accordance with an illustrative embodiment. Dyeing system 100 includes a cylinder 102 for storing carbon dioxide ($CO_2$). Cylinder 102 is connected to a pump and regulator 104. Pump and regulator 104 are configured to pump $CO_2$ into and out of temperature/pressure vessel 110 and to maintain the pressure of the $CO_2$ within temperature/pressure vessel 110 as known to those of skill in the art. A heating apparatus 108 is configured to heat the contents of temperature/pressure vessel 110 according to signals received from a temperature controller 106 as further described below with respect to FIG. 2. In an embodiment, temperature controller 106 may include a sensor for sensing the present temperature of the contents of temperature/pressure vessel 110, a computer for comparing the present temperature to a threshold temperature, and an output device for transmitting a signal to control the operation of heating device 108. In alternative embodiments, temperature controller 106 may comprise any device known by those of skill in the art that is capable of controlling a heating device 108 in order to bring contents of a container to a predetermined minimum temperature and to maintain the contents at that temperature. In an embodiment, temperature/pressure vessel 110 includes a hatch or door through which fabric and/or dye may be placed within temperature/pressure vessel 110. In alternative embodiments, temperature/pressure vessel 110 may include a separate inlet port or hatch through which dye may be placed within temperature/pressure vessel 110.

In an embodiment, dyeing system 100 may be any system known to those of skill in the art that is capable of raising and maintaining an elevated temperature and pressure of $CO_2$ for sc-$CO_2$ extraction/cleaning processes. In illustrative embodiments, dyeing system 100 is configured such that a temperature and pressure within temperature/pressure vessel 110 can be selected to exceed the critical point of $CO_2$, for example, 31.1 degrees Celsius and 7.39 megapascals (MPa).

Dyeing system 100 may include additional components or have alternative configurations as known to those of skill in the art. Temperature/pressure vessels have been commonly used to enable a temperature and pressure of a quantity of $CO_2$ to exceed the critical point of $CO_2$ for a variety of uses. For example, similar temperature/pressure vessels have been used for removing caffeine from coffee beans, for industrial cleaning of parts, and for drug extraction processes. Examples of similar commercial equipment as known to those of skill in the art include supercritical fluid processing/extraction devices as available from Deven Supercriticals PVT, LTD and Ruian Shengtai Pharmaceutical Machinery Co., Ltd. Example laboratory scale equipment, e.g., compressed gas extractors, is produced by Eden Labs.

Figure 2:
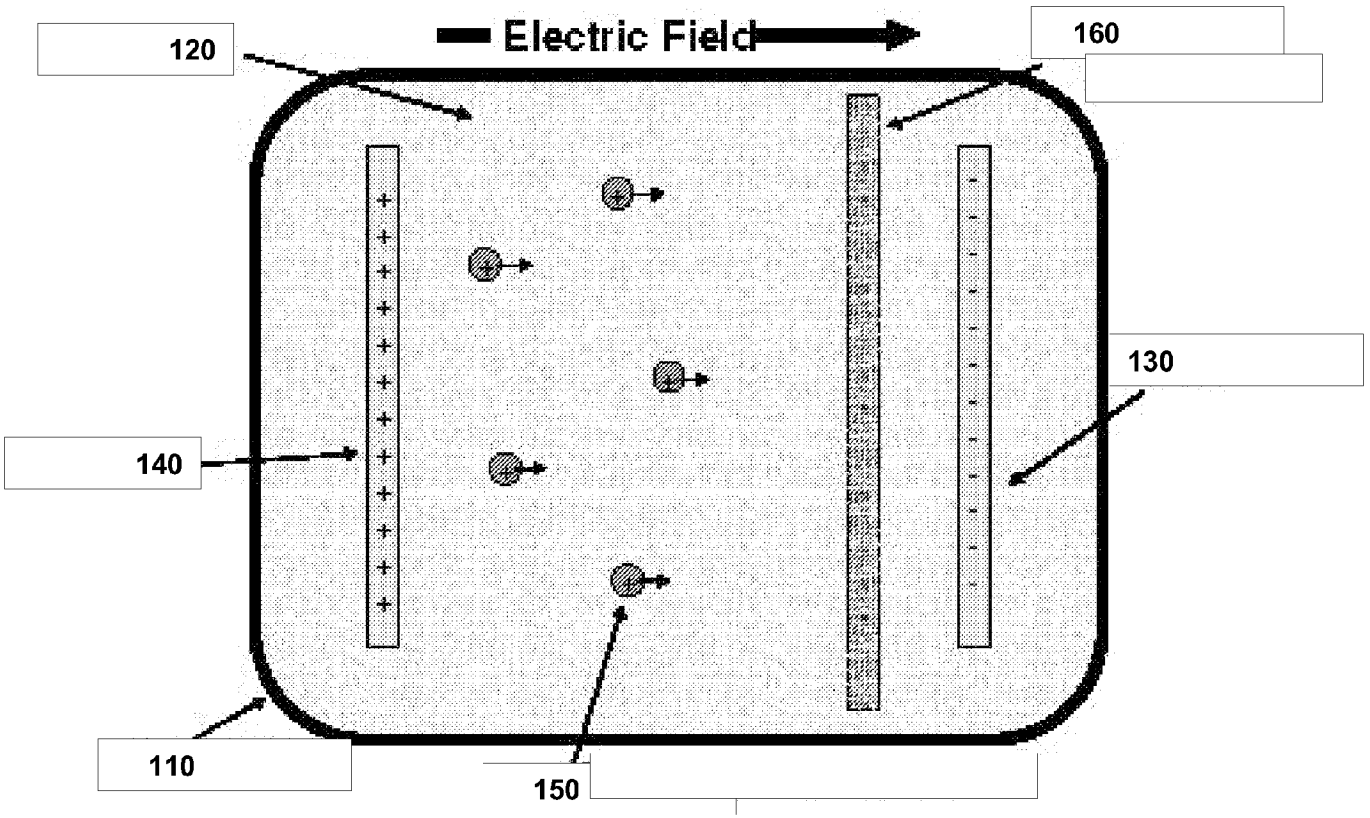
FIG. 2 depicts a temperature/pressure vessel in accordance with an illustrative embodiment.

FIG. 2 depicts temperature/pressure vessel 110 of sc-$CO_2$ dyeing system 100 in accordance with an illustrative embodiment. In an embodiment, sc-$CO_2$ 120, a dye, and optionally a surfactant are placed in temperature/pressure vessel 110 and intermixed. Example dyes that may be utilized include, but are not limited to reactive dyes, disperse dyes, direct dyes, anthraquinone vat dyes, indigold dyes, sulfur dyes, cationic azo dyes, cationic methine dyes, acid dyes, metal complex dyes, and napthoquinone dyes. Sc-$CO_2$ is non-polar in that its molecules generally have electrons that are distributed symmetrically thus preventing the formation of electric poles on the molecules. As such, sc-$CO_2$ generally does not mix well with polar dyes. In contrast to non-polar molecules, polar dyes have electric poles, e.g., a net positive charge on a first side of the molecule and a net negative charge on a second side of the molecule. A surfactant is a wetting agent having both a polar end and a non-polar end. Example surfactants may include, but are not limited to, aerosol-OT, OLOA-1200, tergitol, perfluoropolyether, Triton X100, pluronics, or any other surfactant known to those of skill in the art and that is capable of facilitating the dispersion of dyes into sc-$CO_2$. The surfactant facilitates the dispersion of the polar dyes within the non-polar sc-$CO_2$ by bonding to each through polar and non-polar bonds. Such bonds may include, but are not limited to, ionic and hydrogen bonds. For example, the polar ends of the surfactant can bond with the polar dyes via a polar bond (e.g., ionic bond) and the non-polar ends of the surfactant can bond with the non-polar Sc-$CO_2$ via a non-polar bond (e.g., a hydrogen bond). Examples of mixtures of dyes with surfactants include, but are not limited to, a mixture of dry disperse blue 77 dye and a polydimethylsiloxane polymer end terminated with 3-([2-hydroxy-3-diethylamino] propoxy) propage groups or a mixture of conventional acid dyes with perfluoro 2,5,8,11-tetramethyl-3,6,9,12-tetraoxapentadecanoic acid ammonium salt.

Accordingly, upon being placed in temperature/pressure vessel 110, the dye is intermixed with sc-$CO_2$ 120 using the surfactant to create a dye/sc-$CO_2$ mixture as appropriate. In an embodiment, the dye, sc-$CO_2$, and surfactant are separately placed into temperature/pressure vessel 110 via one or more inlet ports. In an alternative embodiment, the surfactant and the dye may be placed into temperature/pressure vessel 110 together. In another embodiment, the dye, sc-$CO_2$, and surfactant may be placed within temperature/pressure vessel 110 in any manner known to those of skill in the art. Temperature/pressure vessel 110 is configured to raise the temperature and pressure of the dye/solvent mixture to a desired working temperature and a desired working pressure and maintain the desired working temperature and pressure throughout the subsequent dyeing process. In an embodiment, the temperature and pressure are selected such that the $CO_2$ is maintained in a supercritical state. As such, the $CO_2$ is maintained at a temperature greater than 31.3 degrees Celsius and at a pressure greater than 7.39 MPa. Although solubility of dyes and surfactants are not strongly temperature and pressure dependent when used with the appropriate surfactant, the elevated temperature of the dye/sc-$CO_2$ mixture enhances the ability of the dye to diffuse into a textile.

A cathode 130 and an anode 140 are located within temperature/pressure vessel 110 and are configured to generate an electric field within temperature/pressure vessel 110. Upon application of a sufficient electric field to the dye/sc-$CO_2$ mixture, the dye particles become ionized as the electric charges within the dye are separated, thereby forming charged dye particles 150. The electric field is used to enhance the diffusion of charged dye particles 150 into a fabric 160. Fabric 160 may comprise a natural fiber such as cotton, wool, silk, linen, or ramie, a synthetic fiber such as polyester, rayon, acrylic, etc., or a blend of natural and synthetic fibers. The required strength of the electric field depends on the type of dye used and the energy required to dissociate the charges of the dye particles. In an embodiment, an electric field of between 300 kilovolts per meter (kV/m) and 400 kV/m is used, although alternative embodiments may include electric fields having different strengths depending on the dye used and the energy required to dissociate the charges of the dye particles. The high dielectric strength of sc-$CO_2$ (about 450 MV/m) prevents breakdown of the sc-$CO_2$.

The required distance between cathode 130 and anode 140 is a function of the potential between cathode 130 and anode 140. The distance between cathode 130 and anode 140 must be large enough that fabric 160 may be passed between cathode 130 and anode 140. However, a shorter distance between cathode 130 and anode 140 will result in a smaller required potential between cathode 130 and anode 140 to produce an electric field having a given strength. For example, in an embodiment, the distance between cathode 130 and anode 140 is 1 cm. At a distance of 1 cm, a potential of 4 kV between cathode 130 and anode 140 is required to generate an electric field of 400 kV/m. However, at a distance of 5 cm, a potential of 20 kV between cathode 130 and anode 140 is required to generate an electric field of 400 kV/m. As such, the distance between cathode 130 and anode 140 should be minimized as much as possible given the distance required by fabric 160 in order to reduce the required potential between cathode 130 and anode 140. Reducing the required potential between cathode 130 and anode 140, reduces the amount of energy required, is safer than a higher potential, and is less complex than a system requiring high potentials.

During the textile dyeing process, fabric 160 is contacted with the dye/sc-$CO_2$ mixture and passed between cathode 130 and anode 140 which generate an electric field about fabric 160. In an embodiment, fabric 160 is completely immersed within the dye/sc-$CO_2$ mixture within temperature/pressure vessel 110. In an embodiment, fabric 160 is placed within temperature/pressure vessel 110 via an inlet port prior to placement of the dye, the sc-$CO_2$, and the surfactant within temperature/pressure vessel 110. In an alternative embodiment, the dye and the surfactant are placed within temperature/pressure vessel 110 prior to placement of fabric 160 within temperature/pressure vessel 110.

In the embodiment illustrated in FIG. 1, charged dye particles 150 are positively charged. Positively charged dye particles 150 include, but are not limited to, basic dyes that have a $-NH_2^+$ or a $-NH_3^+$ group, thus giving the particles a charge in solution of +1. Examples of such dyes include, but are not limited to, methylene blue chloride, basic yellow 11, and basic orange 21. As a result, when the electric field is generated by cathode 130 and anode 140, the positively charged dye particles 150 are repelled from anode 140 (which is also positively charged) and attracted to cathode 130 (which is negatively charged). In this way, charged dye particles 150 are more effectively diffused into fabric 160, which is positioned between cathode 130 and anode 140.

In an alternative embodiment, charged particles 150 may be negatively charged. Negatively charged dye particles would include, but are not limited to, acid dyes such as Anthraquinone type dyes (blue in color) or Triphenylmethane type dyes (yellow or green in color). According to such an embodiment, upon generation of an electric field by cathode 130 and anode 140, the negatively charged dye particles are repelled from cathode 130 (which is also negatively charged) and attracted to anode 140 (which is positively charged).

In an illustrative embodiment, when positively charged particles 150 are used, fabric 160 is held nearer to cathode 130 than to anode 140. Holding fabric 160 nearer cathode 130 increases the volume of the dye/solvent mixture and the corresponding quantity of charged particles 150 between anode 140 and fabric 160. As a result of the electric field, positively charged particles 150 are pulled from the volume of the dye-solvent mixture between anode 140 and fabric 160 into fabric 160. The volume between anode 140 and fabric 160 will be maximized by maintaining fabric 160 as close as possible to cathode 130. The greater the volume between anode 140 and fabric 160, the greater the quantity of charged particles 150 available to be pulled into fabric 160, and thus the greater the quantity of charged particles 150 that may be diffused into fabric 160. In addition, fabric 160 acts as a filter in that it prevents positively charged particles 150 from accumulating on cathode 130. Heavy accumulation of dye particles on cathode 130 would require routine cleaning.

Conversely, in the alternative embodiment where charged particles 150 are negatively charged, fabric 160 is held nearer to anode 140 than to cathode 130. Negatively charged particles will be attracted to anode 140. As a result, the volume between cathode 130 and fabric 160 should be maximized to increase the quantity of negatively charged particles available to be diffused into fabric 160 and to minimize the negatively charged dye particles accumulating on anode 140.

Figure 3:
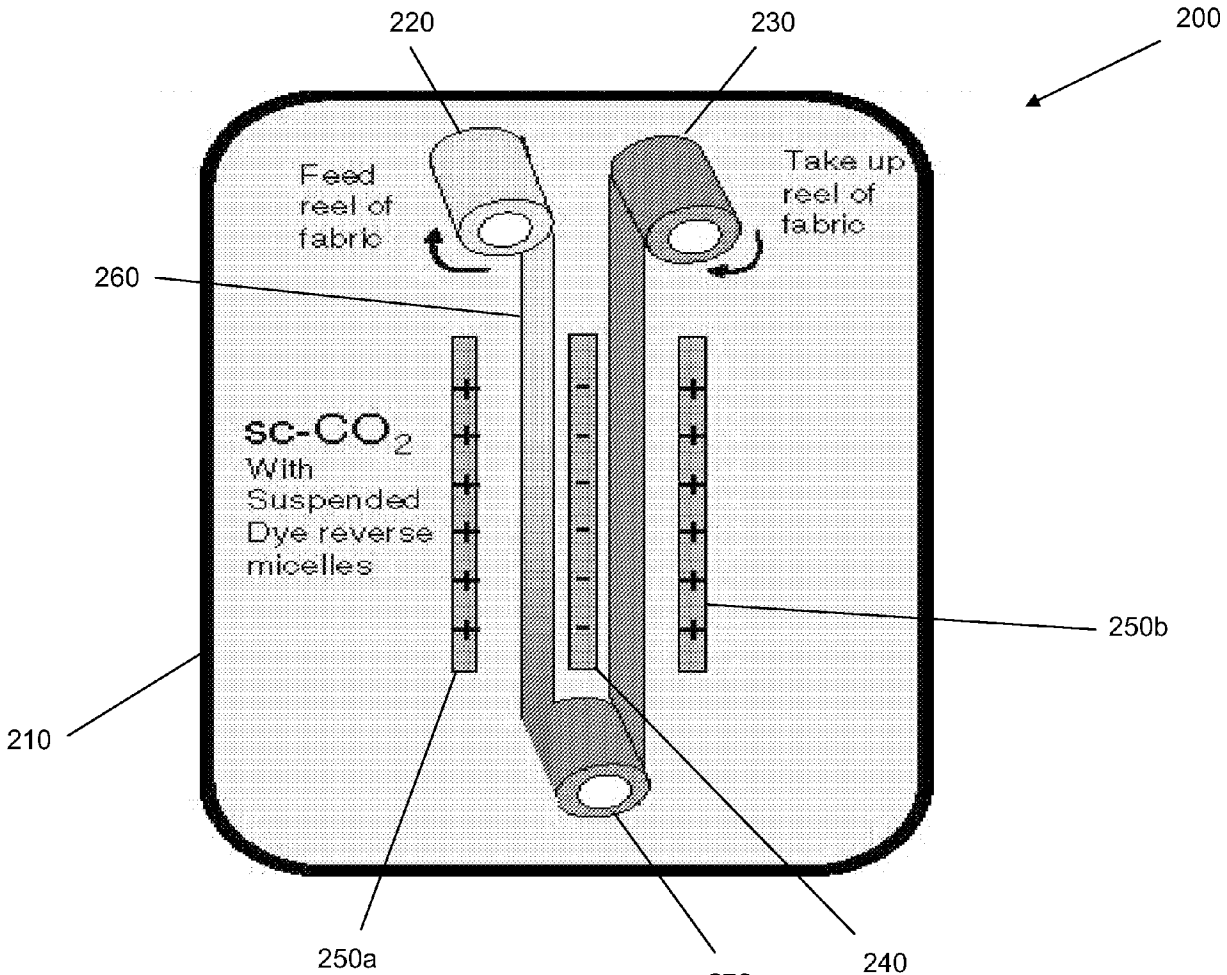
FIG. 3 depicts a dyeing apparatus including a reel-to-reel transfer mechanism in accordance with another illustrative embodiment.

FIG. 3 depicts a dyeing apparatus 200 that includes a reel-to-reel transfer mechanism in accordance with an illustrative embodiment. Dyeing apparatus 200 includes a temperature/pressure vessel 210 that is capable of raising and maintaining an elevated temperature and pressure of a dye solution for dyeing textiles.

During a dyeing process, sc-$CO_2$, a dye, and a surfactant are placed in temperature/pressure vessel 210 as described above with respect to FIG. 1, and, upon being placed in temperature/pressure vessel 210, the dye is dispersed into the sc-$CO_2$ using the surfactant to create a dye/solvent mixture.

Dyeing apparatus 200 also includes a cathode 240 and anodes 250*a*, 250*b*. Cathode 240 and anodes 250*a*, 250*b* are configured to generate respective electric fields within temperature/pressure vessel 210. For example, a first electric field is created between cathode 240 and anode 250*a* and a second electric field is created between cathode 240 and anode 250*b*. In alternative embodiments, any number of cathodes and anodes may be used to generate any number of electric fields.

Upon application of a sufficient electric field to the dye/solvent mixture, the dye particles become ionized as the electric charges within the dye are separated, thereby forming charged dye particles. The electric fields are used to enhance the diffusion of the charged dye particles into a fabric 260 which is immersed in the dye/solvent mixture within temperature/pressure vessel 210.

In the embodiment of FIG. 2, fabric 260 is mounted on a feed reel 220, on a pivot reel 270, and on a take up reel 230. Using feed reel 220, pivot reel 270, and take up reel 230, fabric 260 is fed from feed reel 220, passed through the first electric field generated between cathode 240 and anode 250*a*, pivoted about pivot reel 270, and passed through the second electric field generated between cathode 240 and anode 250*b*. After fabric 260 has been passed through the first and second electric fields, fabric 260 is collected on take up reel 230. An external control system (not shown) is used to control the operation of the feed, pivot, and take up reels as known to those of skill in the art.

As fabric 260 is passed through the various electric fields positively charged dye particles are repelled from anodes 250*a*, 250*b* (which is also positively charged) and attracted to cathode 240 (which is negatively charged). In this way, charged dye particles are more effectively diffused into fabric 260 which is passed between cathode 240 and anodes 250*a*, 250*b*. Accordingly, as fabric 260 is passed through the various electric fields, it gradually accumulates more and more dye. In this way, substantial lengths of fabric can be fed through the electric fields and dyed in an efficient and effective manner.

In alternative embodiments, dyeing apparatus 200 may include any number of cathodes, anodes, and pivot reels in order to pass fabric 260 along any desired path and through any number of electric fields.

Figure 4:
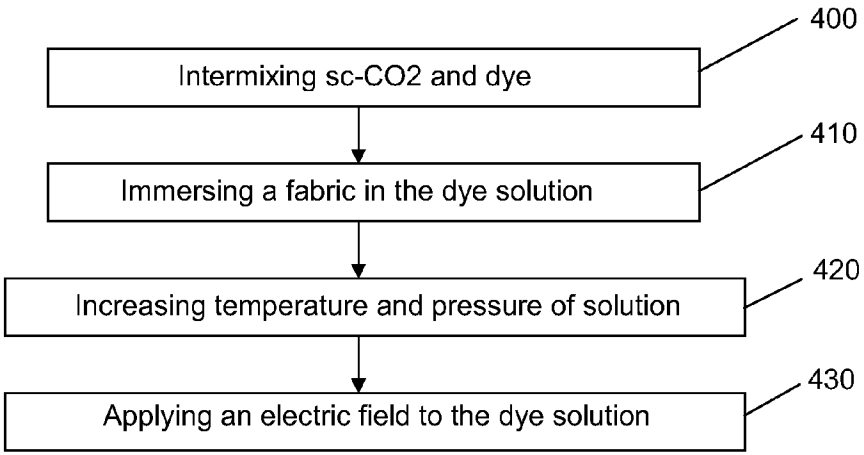
FIG. 4 depicts a method for dyeing textiles in accordance with an illustrative embodiment.

FIG. 4 depicts a method for dyeing textiles in accordance with an illustrative embodiment. In an operation 400, a dye solution is created by intermixing in a temperature/pressure vessel a dye with super critical carbon dioxide (sc-$CO_2$) using a surfactant. The surfactant is a wetting agent that facilitates the dispersion of the polar particles of the dye within the non-polar sc-$CO_2$, as the surfactant has both polar and non-polar ends that are capable of bonding to both polar and non-polar particles.

A fabric is immersed in the dye solution in an operation 410. In an illustrative embodiment, the fabric comprises natural fibers such as, but not limited to, cotton, wool, silk, linen, or ramie. In alternative embodiments, the fabric may comprise a synthetic fiber such as, but not limited to, polyester, rayon, acrylic, etc., or a blend of natural and synthetic fibers.

In an operation 420, the temperature of the dye solution is raised to a desired working temperature and a pressure applied to the dye solution is raised desired working pressure. The temperature and pressure are maintained at an elevated state throughout the subsequent dyeing process in order to maintain the sc-$CO_2$ in its super-critical state and to enhance the ability of the dye to diffuse into a textile.

An electric field is applied to the dye solution in an operation 430. The electric field is used to enhance the diffusion of charged dye particles into the fabric. Upon application of an electric field to the dye solution, electric charges within the dye are separated. In an embodiment, the electric field causes negatively or positively charged groups may be separated from the rest of the dye particle, creating a positively or negatively charged dye particle. In an embodiment, the electric field is generated by a cathode and an anode. In alternative embodiments, any number of electric fields may be generated by any number of cathodes and anodes. Upon generation of the electric field, the positively charged dye particles are repelled from the anode (which is also positively charged) and attracted to the cathode (which is negatively charged). The fabric is situated between the cathode and the anode. In this way, positively charged dye particles as they are moving toward the cathode are diffused into the fabric.

In an alternative embodiment, negatively charged dye particles may be used to dye the fabric. The negatively charged dye particles are repelled from the cathode (which is also negatively charged) and attracted to the anode (which is positively charged).

After the dyeing process has been completed, the temperature and pressure of the dye solution may be lowered. In an embodiment, by lowering the pressure of the dye solution, the sc-$CO_2$ may change to a gaseous state and separates from the dye which may remain in a solid or liquid state. As a result of the separation, the sc-$CO_2$ and the dye may be reused in subsequent dyeing processes. As a result, the dyeing process described above has the advantage that it does not produce large amounts of unusable, polluted solvents such as water.

One or more flow diagrams may have been used herein. The use of flow diagrams is not meant to be limiting with respect to the order of operations performed. The herein described subject matter sometimes illustrates different components contained within, or connected with, different other components. It is to be understood that such depicted architectures are merely illustrative, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A method for dyeing textiles, the method comprising:

intermixing a dye with super-critical carbon dioxide (sc-$CO_2$) to form a dye solution;

contacting a fabric with the dye solution; and applying an electric field to the dye solution to cause separation of charges within particles of the dye solution and to cause the dye to diffuse into the fabric.

2. The method of claim 1, wherein the fabric comprises at least one of wool, cotton, silk, linen, or ramie fibers.

3. The method of claim 1, wherein the dye is a hydrophilic dye.

4. The method of claim 1, wherein the dye is a polar dye.

5. The method of claim 1, wherein said intermixing a dye with sc-$CO_2$ includes increasing the temperature of the dye solution and maintaining the dye solution at an elevated pressure.

6. The method of claim 1, wherein the electric field comprises a strength of at least 300 kilovolts per meter.

7. The method of claim 1, further comprising treating the dye with a surfactant to facilitate said intermixing.

8. An apparatus for dyeing textiles, the apparatus comprising:

an intermixing component configured to retain and intermix a dye with super-critical carbon dioxide (sc-$CO_2$) to form a dye solution;

a fabric immersion component configured to contact a fabric with the dye solution; and a cathode and an anode configured to produce an electric field in the dye solution, wherein the electric field causes separation of charges with particles of the dye solution to ionize and cause the dye to diffuse into the fabric.

9. The apparatus of claim 8, wherein the charged particles comprise positively charged particles, and wherein the fabric immersion component is configured to provide the fabric nearer to the cathode than to the anode.

10. The apparatus of claim 8, wherein the charged particles comprise negatively charged particles, and wherein the fabric immersion component is configured to provide the fabric nearer to the anode than to the cathode.

11. The apparatus of claim 8, wherein the electric field comprises a strength of between 300 kilovolts per meter and 400 kilovolts per meter.

12. The apparatus of claim 8, wherein the cathode and the anode are separated by a distance of about 1 cm.

13. The apparatus of claim 8, wherein the intermixing component comprises a pressure vessel that is configured to maintain the dye solution at an elevated pressure.

14. The apparatus of claim 13, wherein the cathode and the anode are located within the pressure vessel.

15. The apparatus of claim 13, wherein the pressure vessel is further configured to elevate the temperature of the dye solution and to the maintain the dye solution at the elevated temperature.

16. The method of claim 6, wherein the electric field comprises a strength of between 300 kilovolts per meter and 400 kilovolts per meter.

17. The method of claim 1, wherein the contacting a fabric with the dye solution comprises passing the fabric through the dye solution using a reel-to-reel transfer mechanism.

18. The apparatus of claim 8, wherein the dye is a hydrophilic dye.

19. The apparatus of claim 8, wherein the electric field comprises a strength of at least 300 kilovolts per meter.

20. The apparatus of claim 8, further comprising a reel-to-reel transfer mechanism configured to pass the fabric from a feed reel through the dye solution to a take up reel.

* * * * *

UNITED STATES PATENT AND TRADEMARK OFFICE

CERTIFICATE OF CORRECTION

PATENT NO. : 8,439,982 B2
APPLICATION NO. : 13/125006
DATED : May 14, 2013
INVENTOR(S) : Yager It is certified that error appears in the above-identified patent and that said Letters Patent is hereby corrected as shown below:

In the Claims:

In Column 10, Line 19, in Claim 15, delete "the maintain" and insert -- maintain --, therefor.

Signed and Sealed this
Eighth Day of October, 2013

Teresa Stanek Rea
*Deputy Director of the United States Patent and Trademark Office*